US005280559A

United States Patent [19]

Lane

[11] Patent Number: 5,280,559

[45] Date of Patent: Jan. 18, 1994

[54] ELECTRICAL STORAGE HEATER

[75] Inventor: Richard J. Lane, Stone, United Kingdom

[73] Assignee: CREDA Limited, Staffordshire, United Kingdom

[21] Appl. No.: 679,672

[22] Filed: Apr. 4, 1991

[30] Foreign Application Priority Data

Apr. 10, 1990 [GB] United Kingdom ..... 9008047

[51] Int. Cl.[5] ..... F24H 1/14; H05B 1/00

[52] U.S. Cl. ..... 392/344

[58] Field of Search ..... 392/344, 339, 345, 340, 392/346; 236/16, 46; 126/285R, 77, 290, 83, 400; 16/48.5; 165/902, 18, 26, 40; 251/11, 75; 432/30

[56] References Cited

U.S. PATENT DOCUMENTS 4,473,740 9/1984 Ellis ..... 392/344
4,838,481 6/1989 Diermayer et al. ..... 236/16
4,894,516 1/1990 Ellis ..... 392/344
4,919,329 4/1990 McCabe ..... 236/93 R

FOREIGN PATENT DOCUMENTS 1375545 11/1974 United Kingdom ..... 392/344
2183326 6/1987 United Kingdom ..... 392/344

*Primary Examiner*—Bruce A. Reynolds
*Assistant Examiner*—Michael D. Switzer
*Attorney, Agent, or Firm*—Spencer, Frank & Schneider

[57] ABSTRACT

An electrical storage heater having a heat store which is electrically heated, an internal air passage which extends upwardly through the heat store, a flow controller which is located above the upper end of the internal passage for controlling the convective flow of the air through the internal passage, and an actuator for the flow controller. The actuator includes a bimetallic element secured to the flow controller.

4 Claims, 2 Drawing Sheets

ELECTRICAL STORAGE HEATER

BACKGROUND OF THE INVENTION

This invention relates to electrical storage heaters.

Such heaters comprise a heat store, electrical means for heating the heat store, an internal air passage extending through the heat store, flow control means for controlling the convective flow of air through the internal passage, and means for actuating the flow control means.

The electrical heating means is powered from an electrical supply source which is only powered at certain restricted periods over each 24 hour period e.g., only from midnight until 7 am, referred to as an off-peak supply period. A small amount of heat stored during the off-peak period is dissipated but, with an adequately insulated heat store, the bulk of the heat is given out during the remainder of the time, referred to as the on-peak period.

The rate at which the heat is to be given out is not necessarily uniform: the storage heater should have an appropriate capacity for the room to be heated, but the amount of heat received or lost by the room from other factors such as solar heating through a window or loss due to draughts from an open door may vary and the flow means enables the rate of heat output to be varied accordingly.

The flow control means in such storage heaters is commonly a damper which is moveable by actuating means to cover and uncover an opening which communicates with the internal passage.

In one known form of storage heater (described in European patent number 017476), the actuating means comprises a bimetallic strip which acts on the damper and which is in turn deflected by a bellows communicating with a bulb sensor containing expansible liquid and sensing ambient temperature variations. The bulb sensor is responsible for causing the damper to open if the temperature in the room containing the heater drops unduly towards the end of an on-peak period, e.g., in the evening, in order to boost the heater output. The bimetallic strip is provided to assist closure of the damper at the start of an off-peak period, both because it is wasteful to heat the store with the damper open (the damper may well be open at the end of the on-peak period), and because it is dangerous so to do since the casing would become unduly hot. The bimetallic strip is positioned so that it is heated by the air rising from the internal passage when the heating elements inside the store are energised.

Nevertheless, it has been found to be desirable to include as well a pilot heater adjacent the room-temperature-sensing bulb sensor, operated by the off-peak electricity, in order to heat the bulb to assist the bimetallic strip in closing the damper. Alternatively the pilot heater may be positioned so as to heat the bimetallic strip.

SUMMARY OF THE INVENTION

The invention provides an electrical storage heater, comprising a heat store, electrical means for heating the store, an internal air passage extending upwardly through the heat store, flow control means arranged above the upper end of the internal passage for controlling the convective flow of air through the internal passage, and means for actuating the flow control means, the actuating means including a bimetallic element secured to the flow control means.

By securing the bimetallic element to the flow control means e.g. the damper, it is heated by conduction from the flow control means as well as by convection, and the improved effectiveness in heating the bimetallic element eliminates the need for the pilot heater.

Conveniently, the bimetallic element may be a strip which may or may not be U-shaped depending on its positioning relative to the flow control means.

BRIEF DESCRIPTION OF THE DRAWINGS

An electrical storage heater constructed in accordance with the invention will now be described by way of example with reference to the accompanying drawings. in which.

DESCRIPTION OF THE PREFERRED EMBODIMENTS

Figure 1:
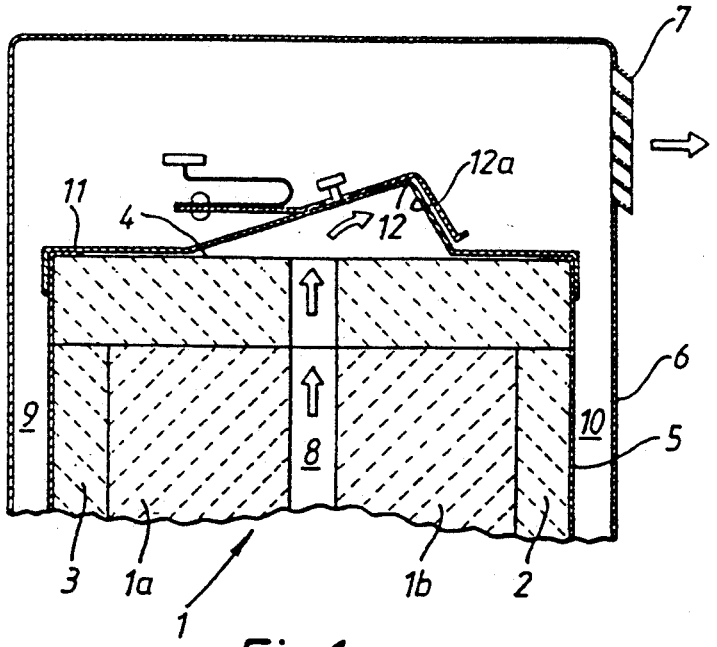
FIG. 1 is a vertical cross-section of a part of the storage heater.

The storage heater has a heat store 1 surrounded by heat insulating material (the front 2, rear 3 and top 4 panels being shown) contained in an inner casing 5, housed inside an outer casing 6 which has a heat output grille 7 at the front. The outer casing is spaced away from the inner casing.

The heat store consists of pairs of bricks 1*a*, 1*b* arranged on end with the smallest dimension of the bricks extending from front to rear of the storage heater (from side to side in the plane of the paper in the drawing). The bricks are in contact face to face, the width and height of the face being much greater than the thickness of the bricks, but the bricks only meet at the vertical edges. The bricks 1*a* and 1*b* have a recessed vertical channel between the vertical edges which define a vertical channel 8 between each pair of bricks. The pairs of bricks are stacked in vertical columns so that the vertical channels 8 run right through the store from the bottom to the top. When the store is charged by electrical heating means (not shown) arranged in the channels 8, the store loses its heat partly by conduction through the heat insulating material 2, 3, 4 but to a greater extent through convection of air through the internal air passage 8—see the arrows—when that passage is open at the top end.

The air emerging from the heat outlet grille 7 thus results from convection up the external passageways 9, 10 between the inner and outer casings 5 and 6 as well as from convection up the internal passageway 8 when the upper end is open.

Figure 2A:
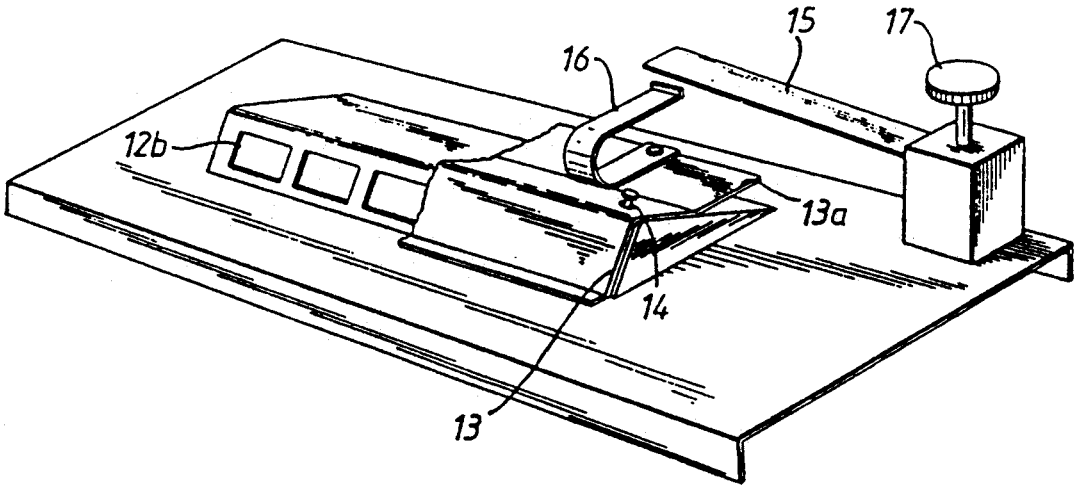
FIG. 2*a* is a perspective view of a part of the storage heater.

The inner casing 5 is closed at its upper end by top panel 11 which has a ridge 12 formed integrally with it, one face 12*a* of the ridge having ventilation apertures 12*b*. These apertures can be covered or uncovered by flow control means in the form of a damper 13 which has an aperture at each end through which a pivot 14 extends. In the illustrated position, the damper rests in a position in which the apertures 12*b* are covered. If the rear flap 13*a* of the damper is depressed (FIG. 2*a*), the damper pivots about pivot points 14 and uncovers the apertures 12*b*. If the downward pressure on the rear flap 13*a* ceases, the damper returns under gravity to its illustrated position.

Depression of the damper flap 13*a* is caused by an actuating means in the form of an actuating arm 15 which acts on the damper flap via a U-shaped strip 16 of bimetal secured to the damper flap. The damper arm can be tilted by turning an adjustable knob 17, which a user can set to a desired heat output, and by the action of a bellows arrangement (not shown) containing an expansible liquid. The bellows is in communication with a bulb sensor arranged near an inlet towards the lower end of the casing, in order to be responsive to fluctuations in ambient temperature. Decrease in ambient temperature cause the bellows to contract and the actuating arm 15 to be depressed, thereby tending to open the damper.

When the temperature of the bimetallic strip rises, the arms deflect in such a way (by moving together) to assist the closure of the damper at the commencement of an off-peak period. Towards the end of the preceding on-peak period, e.g., in late evening, if the room containing the heater was falling in temperature, the actuating arm 15 would have opened the damper. Thus, the damper would have been open at the commencement of the next off-peak period, which means that hot air will convect directly from the electrical heating elements through the internal air passage 8 and out through the ventilation apertures 12*b*. In order to prevent wastage of heat and to avoid the danger of the heater casings 5 and 6 from becoming too hot, the bimetallic strip is heated and as a result deflects to allow the damper to close.

In previous forms of storage heater, a straight bimetallic strip has been attached to a damper actuating arm so as to act as a continuation of that arm, and the bimetallic strip itself, not the damper actuating arm, has borne against the damper. In accordance with the invention, the bimetallic strip is secured to the damper itself and not to the damper actuating arm 15.

Because the bimetallic strip is secured to the damper flap, it is now heated by conduction from the damper, which can get very hot and is a good conductor of heat, as well as by convention from the heated air from the internal passage, instead of receiving substantially all its heat by convection currents as hitherto. This means that a pilot heater is no longer required to provide an additional heat input to the bulb sensor during the off-peak periods, in order to provide an additional lifting force on the actuating arm.

Figure 2B:
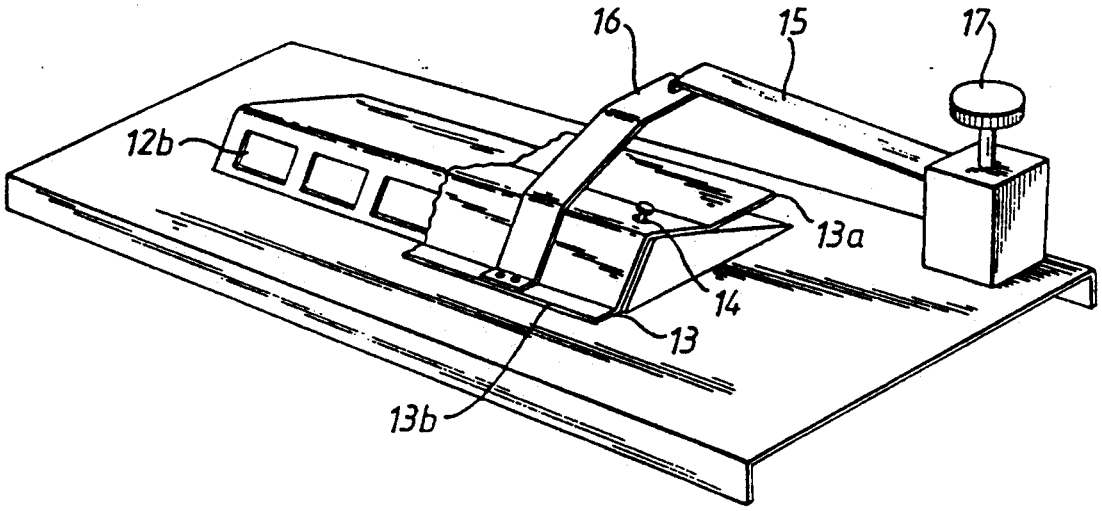
FIG. 2*b* is a perspective view of a part of an alternative construction.

In an alternative construction shown in FIG. 2*b*, a bimetallic strip 16 is secured to a front lip 13*b* of the damper 13 and is not U-shaped. The operation is the same as that described with reference to FIG. 2*a*.

In summary, an electrical storage heater comprises a heat store, electrical means for heating the heat store, an internal air passage extending through the heat store and a damper for controlling the convective flow of air through the internal passage and out of ventilation apertures 12*b*.

To provide a controllable heat output, the user can adjust a knob 17 to vary the tilting of an arm 15 for tilting the damper 13 to either cover or uncover the apertures 12*b*. The tilting of the arm is also affected by a bulb sensor sensing temperature fluctuations in the room.

A bimetallic strip is provided to assist in damper closing at the start of an off-peak period, but in accordance with the invention it is secured to the damper itself rather than to the actuating arm 15, and so benefits from heat reception by conduction from the damper instead of simply convection as hitherto. This enables an off-peak operated pilot heater for the room temperature sensor to be deleted.

I claim:

1. An electrical storage heater, comprising:

an electrically heated heat store, said heat store having an internal air passage extending upwardly therethrough, and an upper end;

flow control means positioned above the upper end of said internal air passage for controlling a convective flow of air through said internal air passage; and actuating means for actuating said flow control means, said actuating means including a bimetallic element which deflects in response to temperature variations in said bimetallic element caused by convective air flow through the internal air passage, said bimetallic element having no heat assisting elements and being secured to said flow control means to receive heat from said flow control means by conduction.

2. A heater as claimed in claim 1, in which said bimetallic element is a bimetallic strip.

3. A heater as claimed in claim in claim 1, in which said flow control means includes a pivot and is pivotable thereabout for controlling the convective flow of air, and wherein said bimetallic element is secured to a region of said flow control means remote from said pivot.

4. A heater as claimed in claim 1, in which said flow control means includes a pivot and is pivotable thereabout for controlling the convective flow of air, and wherein said bimetallic strip is secured to a region of said flow control means remote from said pivot.

* * * * *